US009748621B2

(12) United States Patent
Pan et al.

(10) Patent No.: US 9,748,621 B2
(45) Date of Patent: Aug. 29, 2017

(54) STEP IMPEDANCE RESONATOR FILTER

(71) Applicant: I-SHOU UNIVERSITY, Kaohsiung (TW)

(72) Inventors: Chung-Long Pan, Kaohsiung (TW); Rong-Ching Wu, Kaohsiung (TW); Tsu-Chung Tan, Kaohsiung (TW)

(73) Assignee: I-Shou University, Kaohsiung (TW)

( * ) Notice: Subject to any disclaimer, the term of this patent is extended or adjusted under 35 U.S.C. 154(b) by 47 days.

(21) Appl. No.: 14/983,635

(22) Filed: Dec. 30, 2015

(65) Prior Publication Data

US 2017/0194683 A1 Jul. 6, 2017

(51) Int. Cl.
*H01P 1/203* (2006.01)

(52) U.S. Cl.
CPC ..... *H01P 1/203* (2013.01)

(58) Field of Classification Search
CPC .. H01P 1/203; H01P 1/20327; H01P 1/20354; H01P 1/20363; H01P 1/20381; H01P 1/2039
USPC ..... 333/204, 205
See application file for complete search history.

(56) References Cited

U.S. PATENT DOCUMENTS 3,104,362 A * 9/1963 Matthaei ..... H01P 1/20363 333/204
4,494,086 A * 1/1985 Dydyk ..... H03B 9/147 331/107 DP

FOREIGN PATENT DOCUMENTS

TW M300376 U 11/2006
TW 200742161 11/2007
TW 200937728 A 9/2009

* cited by examiner

*Primary Examiner* — Stephen E Jones
(74) *Attorney, Agent, or Firm* — Alan D. Kamrath; Kamrath IP Lawfirm, P.A.

(57) ABSTRACT

A step impedance resonator filter including a first resonator and a second resonator is disclosed. The first resonator includes a first coupled line and a first tapped line connected to the first coupled line. The second resonator includes a second coupled line and a second tapped line connected to the second coupled line. The second coupled line is coupled with the first coupled line. The first tapped line has a first central line which is spaced from an end face of the first coupled line at a first distance. The second tapped line has a second central line which is spaced from an end face of the second coupled line at a second distance. The first distance is larger than the second distance. As such, the performance of the step impedance resonator filter can be improved.

15 Claims, 2 Drawing Sheets

STEP IMPEDANCE RESONATOR FILTER

BACKGROUND OF THE INVENTION

1. Field of the Invention

The present disclosure generally relates to a step impedance resonator filter and, more particularly, to a step impedance resonator filter whose performance can be improved by changing the locations of the tapped lines.

2. Description of the Related Art

Wireless communication technology has changed the way people exchange messages. In order to meet different demands of the users exchanging messages, the wireless transceivers with multiple modes and multiple bandwidths have become the essential components in the communication system. For example, since the wireless communication standards IEEE802.11a and IEEE802.11g operate at the bandwidths of 2.4 GHz and 5.2 GHz respectively, the wireless transceiver must include a band-pass filter in order to operate at both the bandwidths of 2.4 GHz and 5.2 GHz. The band-pass filter is able to form a band-pass effect at each of the frequencies of 2.4 GHz and 5.2 GHz while excluding the signals at any frequency other than the above two frequencies, thereby achieving the multi-bandwidth transmission.

A band-pass filter may be formed by one or more step impedance resonators (SIR). For example, the band-pass filter may include two resonators. Each of the resonators usually has an electrical length of a half or a quarter of the wavelength, and includes a coupled line and a tapped line. The coupled lines of the two resonators are coupled with each other in order to deliver the signals. The tapped lines of the two resonators may be used as a signal input end and a signal output end, respectively.

In general, the magnitude of the insertion loss and the ability to generate the transmission zeros at the desired frequency have been the important indicators in evaluating the performance of the filter. However, the lengths or widths of the coupled lines of the two resonators are often changed to improve the insertion loss of the conventional step impedance resonator filter and to adjust the locations of the transmission zeros of said filter without taking the locations of the tapped lines into consideration. As a result, the insertion loss of the conventional step impedance resonator filter cannot be further reduced, and the transmission zeros cannot be precisely generated at the intended frequencies.

In light of this, it is necessary to provide a novel step impedance resonator filter.

SUMMARY OF THE INVENTION

It is therefore the objective of this disclosure to provide a step impedance resonator filter in which the insertion loss can be reduced and the locations of the transmission zeros can be adjusted by changing the locations of the tapped lines. As such, the performance of the filter can be improved.

In an embodiment of the disclosure, a step impedance resonator filter including a first resonator and a second resonator is disclosed. The first resonator includes a first coupled line and a first tapped line. The first coupled line extends in a first direction and includes a first coupled end and a first free end. The first tapped line extends in a second direction perpendicular to the first direction and is connected to the first coupled line. The second resonator includes a second coupled line and a second tapped line. The second coupled line extends in a direction opposite to the first direction and includes a second coupled end and a second free end. The second tapped line extends in a direction opposite to the second direction and is connected to the second coupled line. The first coupled line includes a first part that is located between the first tapped line and the first coupled end. The second coupled line includes a second part that is located between the second tapped line and the second coupled end. The first part of the first coupled line is partially overlapped and coupled with the second part of the second coupled line in the second direction. The first tapped line has a first central line extending in the second direction. The first central line is spaced from the first coupled end of the first coupled line at a first distance in the first direction. The second tapped line has a second central line extending in the direction opposite to the second direction. The second central line is spaced from the second free end of the second coupled line at a second distance in the first direction. The first distance is larger than the second distance. As such, the performance of the step impedance resonator filter can be improved through the proper control of the first and second distances.

In a form shown, the first tapped line is connected to one side of the first coupled line facing away from the second coupled line. As such, the performance of the step impedance resonator filter can be improved.

In the form shown, the second tapped line is connected to one side of the second coupled line facing away from the first coupled line. As such, the performance of the step impedance resonator filter can be improved.

In the form shown, the first coupled line includes a first section, a second section and a third section that are connected in sequence in the first direction. The first tapped line is connected to the second section and is adjacent to the first section. As such, the performance of the step impedance resonator filter can be improved through the proper control of the first and second distances.

In the form shown, the first central line of the first tapped line is spaced from an end face of the first section at the first distance. As such, the performance of the step impedance resonator filter can be improved through the proper control of the first distance.

In the form shown, the first section has a length that is smaller than a length of the second section but is equal to a length of the third section in the first direction. As such, the performance of the step impedance resonator filter can be improved through the proper control of the first and second distances.

In the form shown, the first section has a width that is larger than a width of the second section but is equal to a width of the third section in the second direction. As such, the performance of the step impedance resonator filter can be improved through the proper control of the first and second distances.

In the form shown, the second coupled line includes a fourth section, a fifth section and a sixth section that are connected in sequence in the direction opposite to the first direction. The fourth section of the second coupled line is coupled with the first section of the first coupled line. The second tapped line is connected to the fifth section and is adjacent to the sixth section. As such, the performance of the step impedance resonator filter can be improved through the proper control of the first and second distances.

In the form shown, the second central line of the second tapped line is spaced from an end face of the sixth section at the second distance. As such, the performance of the step impedance resonator filter can be improved through the proper control of the second distance.

In the form shown, the fourth section has a length that is smaller than a length of the fifth section but is equal to a length of the sixth section in the first direction. As such, the performance of the step impedance resonator filter can be improved through the proper control of the first and second distances.

In the form shown, the fourth section has a width that is larger than a width of the fifth section but is equal to a width of the sixth section in the second direction. As such, the performance of the step impedance resonator filter can be improved through the proper control of the first and second distances.

In the form shown, the first distance is between 12-13.7 mm. As such, the performance of the step impedance resonator filter can be improved through the proper control of the first distance.

In the form shown, the first distance is between 12.8 mm. As such, the performance of the step impedance resonator filter can be improved through the proper control of the first distance.

In the form shown, the second distance is between 9.3-10 mm. As such, the performance of the step impedance resonator filter can be improved through the proper control of the second distance.

In the form shown, the second distance is between 9.3 mm. As such, the performance of the step impedance resonator filter can be improved through the proper control of the second distance.

BRIEF DESCRIPTION OF THE DRAWINGS

The present disclosure will become more fully understood from the detailed description given hereinafter and the accompanying drawings which are given by way of illustration only, and thus are not limitative of the present disclosure, and wherein.

Figure 1:
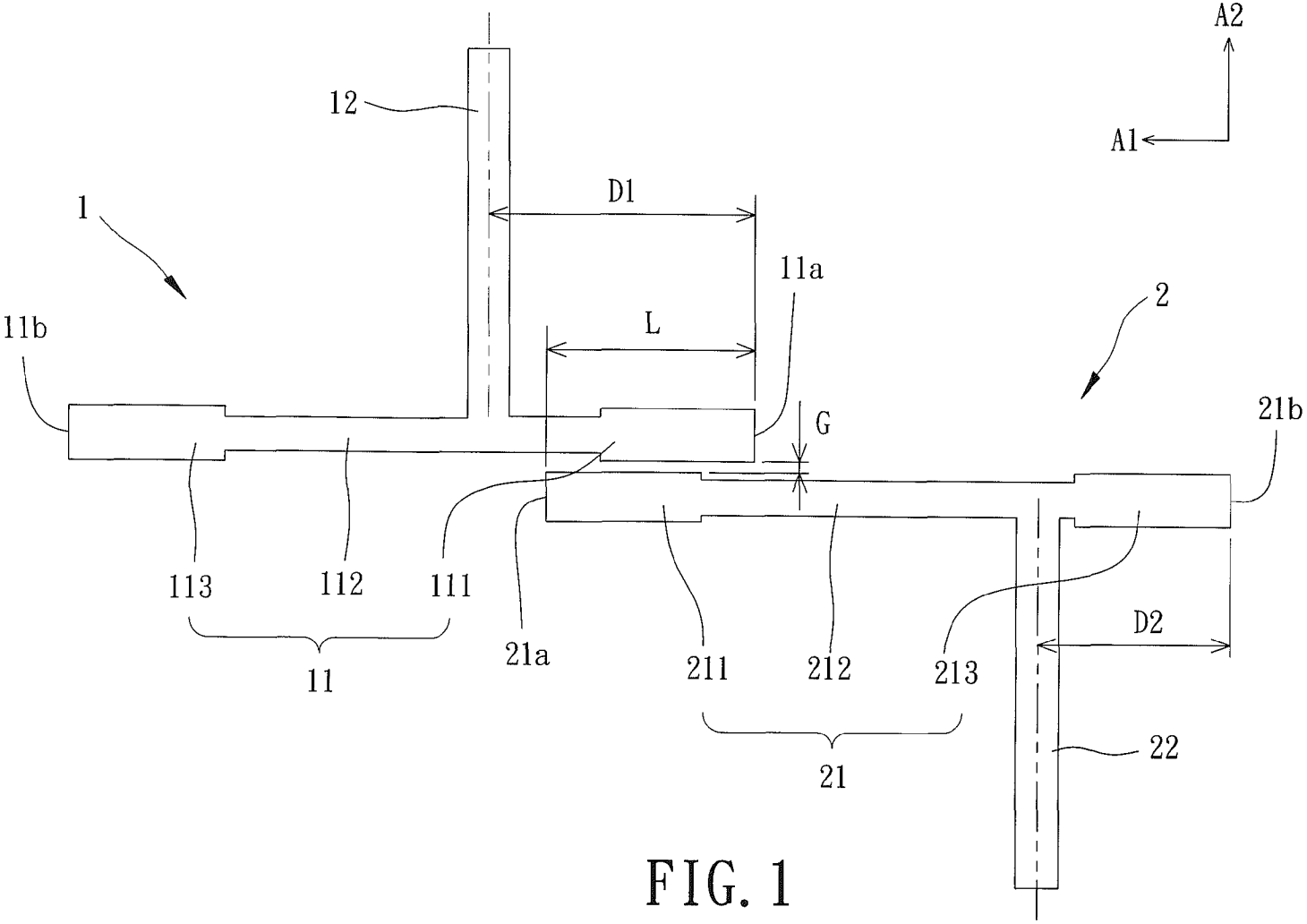
FIG. 1 shows a configuration of a step impedance resonator filter according to an embodiment of the disclosure.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the disclosure.

DETAILED DESCRIPTION OF THE INVENTION

The term "coupled/coupling" refers to a connection mechanism in which the energy is transferred from one medium to another medium.

FIG. 1 shows a configuration of a step impedance resonator filter according to an embodiment of the disclosure. The step impedance resonator filter includes a first resonator 1 and a second resonator 2 coupled with the first resonator 1. The first resonator 1 and the second resonator 2 may be realized by way of layout. For example, the first resonator 1 and the second resonator 2 may be in the form of a plurality of microstrip lines on a substrate. Each of the first resonator 1 and the second resonator 2 may be a step impedance resonator filter and preferably has an electrical length of a quarter of the wavelength.

The first resonator 1 includes a first coupled line 11 and a first tapped line 12. The first coupled line 11 extends in a first direction A1 and includes a first coupled end 11*a* and a first free end 11*b*. The first tapped line 12 extends in a second direction A2 perpendicular to the first direction A1 and is connected to the first coupled line 11.

In the embodiment, the first coupled line 11 includes a first section 111, a second section 112 and a third section 113, which are connected in sequence in the first direction A1. The first section 111 includes an end being the first coupled end 11*a*, and the third section 113 includes an end being the first free end 11*b*. The first tapped line 12 is connected to the second section 112 of the first coupled line 11 and is adjacent to the first section 111 of the first coupled line 11. The first resonator 1 is coupled with the second resonator 2 via the first section 111. The first tapped line 12 has a first central line extending in the second direction A2, which is spaced from the first coupled end 11*a* at a first distance D1 in the first direction A1. Namely, in the first direction A1, the first central line of the first tapped line 12 is spaced from an end face of the first section 111 at the first distance D1. The first distance D1 is provided such that the first tapped line 12 can be connected to a proper location of the first coupled line 11, thereby improving the performance of the step impedance resonator filter.

The first section 111 has a length that is smaller than that of the second section 112 but is equal to that of the third section 113 in the first direction A1. The first section 111 has a width that is larger than that of the second section 112 but is equal to that of the third section 113 in the second direction A2. In this arrangement, the first section 111, the second section 112 and the third section 113 can be designed in a better dimensional relationship to improve the performance of the step impedance resonator filter under a proper value of the first distance D1.

The second resonator 2 includes a second coupled line 21 and a second tapped line 22. The second coupled line 21 extends in a direction opposite to the first direction A1 and includes a second coupled end 21*a* and a second free end 21*b*. The second tapped line 22 extends in a direction opposite to the second direction A2 and is connected to the second coupled line 21. The first coupled line 11 includes a first part that is located between the first tapped line 12 and the first coupled end 11*a*. The second coupled line 21 includes a second part that is located between the second tapped line 22 and the second coupled end 21*a*. The first part of the first coupled line 11 is partially overlapped with the second part of the second coupled line 21 in the second direction A2.

In the embodiment, the second coupled line 21 includes a fourth section 211, a fifth section 212 and a sixth section 213, which are connected in sequence in the direction opposite to the first direction A1. The fourth section 211 includes an end being the second coupled end 21*a*, and the sixth section 213 includes an end being the second free end 21*b*. The fourth section 211 of the second coupled line 21 is coupled with the first section 111 of the first coupled line 11. The second tapped line 22 is connected to the fifth section 212 and is adjacent to the sixth section 213. The second tapped line 22 has a second central line extending in a direction opposite to the second direction A2, which is spaced from the second free end 21*b* at a second distance D2 in the first direction A1. Namely, in the first direction A1, the second central line of the second tapped line 22 is spaced from an end face of the sixth section 213 at the second distance D2. The first distance D1 is larger than the second distance D2. The second distance D2 is provided such that the second tapped line 22 can be connected to a proper location of the second coupled line 21. In this regard, when the first distance D1 is larger than the second distance D2, the performance of the step impedance resonator filter can be improved.

The fourth section 211 has a length that is smaller than that of the fifth section 212 but is equal to that of the sixth section 213 in the first direction A1. The fourth section 211 has a width that is larger than that of the fifth section 212 but is equal to that of the sixth section 213 in the second direction A2. In this arrangement, the fourth section 211, the fifth section 212 and the sixth section 213 can be designed in a better dimensional relationship to improve the performance of the step impedance resonator filter under a proper value of the second distance D2.

After the first tapped line 12 and the second tapped line 22 are respectively connected to the first coupled line 11 and the second coupled line 21, the first tapped line 12 and the second tapped line 22 preferably extend in opposite directions. Specifically, the first tapped line 12 is connected to one side of the first coupled line 11 facing away from the second coupled line 21 and extends away from the second coupled line 21 in the second direction A2. Similarly, the second tapped line 22 is connected to one side of the second coupled line 21 facing away from the first coupled line 11 and extends away from the first coupled line 11 in the direction opposite to the second direction A2. In this arrangement, the first tapped line 12 and the second tapped line 22 can be in a preferred configuration, attaining an improved performance of the step impedance resonator filter.

The length of each of the first tapped line 12 and the second tapped line 22 is not limited. The length and width of each of the first tapped line 12 and the second tapped line 22 are listed in Table 1 below.

TABLE 1

| | | Length/Width (In the First Direction) by Length/Width (In the Second Direction) |
|---|---|---|
| First Resonator | First Section | 7.45 mm × 2.6 mm |
| | Second Section | 18 mm × 2 mm |
| | Third Section | 7.45 mm × 2.6 mm |
| | First Tapped Line | 2 mm × 18 mm |
| Second Resonator | Fourth Section | 7.45 mm × 2.6 mm |
| | Fifth Section | 18 mm × 2 mm |
| | Sixth Section | 7.45 mm × 2.6 mm |
| | Second Tapped Line | 2 mm × 18 mm |

When the length and width of each of the first tapped line 12 and the second tapped line 22 have the values as shown in Table 1 above, each of the first coupled end 11*a* and the second coupled end 21*a* has a coupling length "L" in the first direction A1. Namely, the end face of the first section 111 is spaced from an end face of the fourth section 211 at the coupling length "L." The coupling length "L" is between 5-13 mm, with 10 mm being preferred. Furthermore, the first resonator 1 and the second resonator 2 are spaced from each other at a minimum coupling gap "G" Namely, the first section 111 and the fourth section 211 are spaced from each other at the minimum coupling gap "G" The minimum coupling gap "G" is between 0.4-0.8 mm, with 0.4 mm being preferred. The first distance D1 is between 12-13.7 mm, with 12.8 mm being preferred. The second distance D2 is between 9.3-10 mm, with 9.3 mm being preferred.

Figure 2:
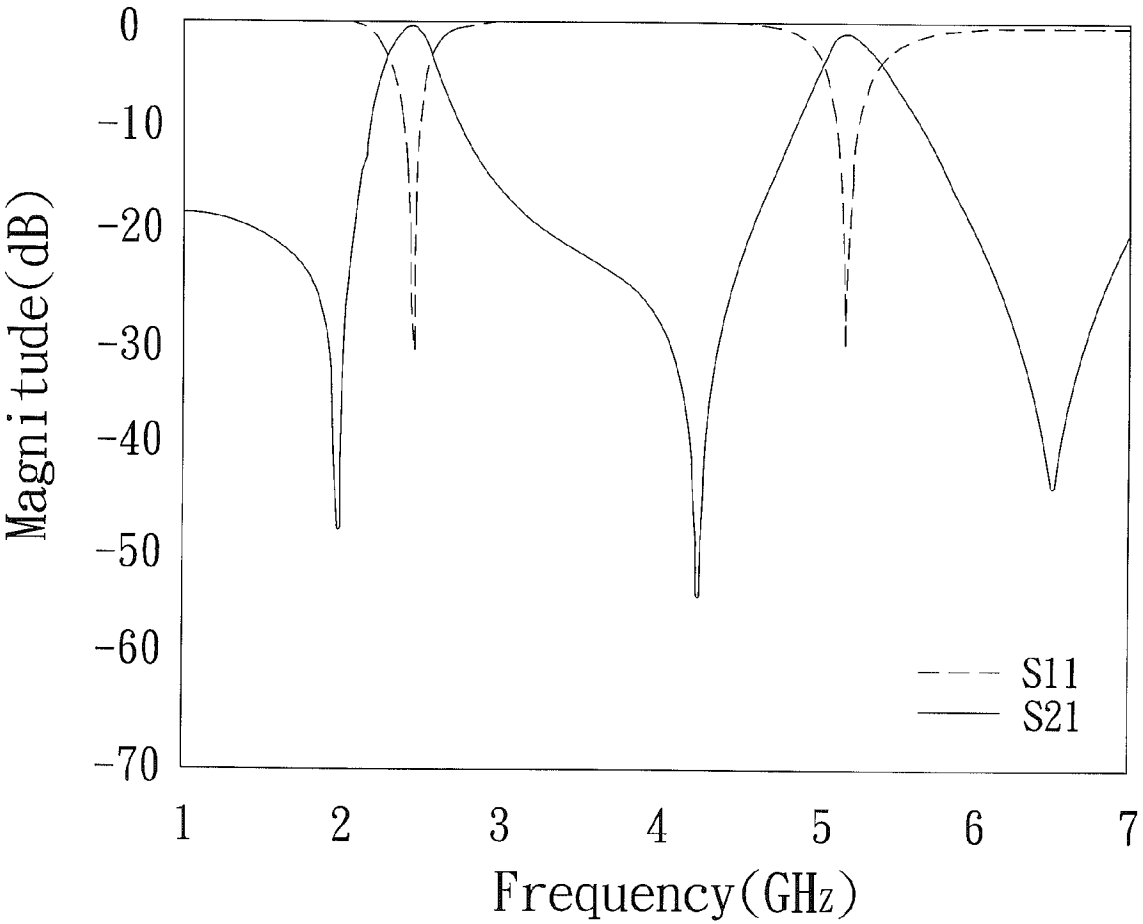
FIG. 2 shows a frequency response diagram of the step impedance resonator filter according to the embodiment of the disclosure.

In order to prove that the step impedance resonator filter according to the embodiment of the disclosure has an excellent performance, the dimensional information in Table 1 is used to generate a simulated frequency response. The simulation can be performed by a processor through the use of a software. The software can be of any conventional software capable of analyzing the frequency response, as it can be readily appreciated by the persons having ordinary skill in the art. FIG. 2 shows a frequency response diagram of the step impedance resonator filter according to the embodiment of the disclosure. In FIG. 2, S11 represents the return loss, and S21 represents the insertion loss. In this regard, the coupling length "L" is 10 mm, the minimum coupling gap "G" is 0.4 mm, the first distance D1 is 12.8 mm, and the second distance D2 is 9.3 mm. It can be observed from FIG. 2 that the insertion loss is 0.24 dB at the frequency of 2.4 GHz, and is 0.91 dB at the frequency of 5.2 GHz. At the same time, two transmission zeros are generated at the frequencies of about 1.98 GHz and 4.27 GHz. The frequency response diagram shows that the step impedance resonator filter according to the embodiment of the disclosure may have a smaller insertion loss, and is able to generate the transmission zeros at the desired frequencies. As a result, the performance of the step impedance resonator filter is improved.

In summary, the step impedance resonator filter according to the embodiment of the disclosure is able to reduce the insertion loss and to generate the transmission zeros at the desired frequencies through adjustment of the locations of the first tapped line 12 and the second tapped line 22. Advantageously, the performance of the step impedance resonator filter is improved.

Although the disclosure has been described in detail with reference to its presently preferable embodiments, it will be understood by one of ordinary skill in the art that various modifications can be made without departing from the spirit and the scope of the disclosure, as set forth in the appended claims.

What is claimed is:

1. A step impedance resonator filter comprising:

a first resonator comprising a first coupled line and a first tapped line, wherein the first coupled line extends in a first direction and comprises a first coupled end and a first free end, wherein the first tapped line extends in a second direction perpendicular to the first direction and is connected to the first coupled line; and a second resonator comprising a second coupled line and a second tapped line, wherein the second coupled line extends in a direction opposite to the first direction and comprises a second coupled end and a second free end, wherein the second tapped line extends in a direction opposite to the second direction and is connected to the second coupled line;

wherein the first coupled line comprises a first part that is located between the first tapped line and the first coupled end, wherein the second coupled line comprises a second part that is located between the second tapped line and the second coupled end, and wherein the first part of the first coupled line is partially overlapped and coupled with the second part of the second coupled line in the second direction;

wherein the first tapped line has a first central line extending in the second direction, wherein the first central line is spaced from the first coupled end of the first coupled line at a first distance in the first direction, wherein the second tapped line has a second central line extending in a direction opposite to the second direction, wherein the second central line is spaced from the second free end of the second coupled line at a second distance in the first direction, and wherein the first distance is larger than the second distance.

2. The step impedance resonator filter as claimed in claim 1, wherein the first tapped line is connected to one side of the first coupled line facing away from the second coupled line.

3. The step impedance resonator filter as claimed in claim 1, wherein the second tapped line is connected to one side of the second coupled line facing away from the first coupled line.

4. The step impedance resonator filter as claimed in claim 1, wherein the first coupled line comprises a first section, a second section and a third section that are connected in sequence in the first direction, and wherein the first tapped line is connected to the second section and is adjacent to the first section.

5. The step impedance resonator filter as claimed in claim 4, wherein the first central line of the first tapped line is spaced from an end face of the first section at the first distance.

6. The step impedance resonator filter as claimed in claim 4, wherein the first section has a length that is smaller than a length of the second section but is equal to a length of the third section in the first direction.

7. The step impedance resonator filter as claimed in claim 4, wherein the first section has a width that is larger than a width of the second section but is equal to a width of the third section in the second direction.

8. The step impedance resonator filter as claimed in claim 4, wherein the second coupled line comprises a fourth section, a fifth section and a sixth section that are connected in sequence in the direction opposite to the first direction, wherein the fourth section of the second coupled line is coupled with the first section of the first coupled line, and wherein the second tapped line is connected to the fifth section and is adjacent to the sixth section.

9. The step impedance resonator filter as claimed in claim 8, wherein the second central line of the second tapped line is spaced from an end face of the sixth section at the second distance.

10. The step impedance resonator filter as claimed in claim 8, wherein the fourth section has a length that is smaller than a length of the fifth section but is equal to a length of the sixth section in the first direction.

11. The step impedance resonator filter as claimed in claim 8, wherein the fourth section has a width that is larger than a width of the fifth section but is equal to a width of the sixth section in the second direction.

12. The step impedance resonator filter as claimed in claim 1, wherein the first distance is between 12-13.7 mm.

13. The step impedance resonator filter as claimed in claim 12, wherein the first distance is 12.8 mm.

14. The step impedance resonator filter as claimed in claim 1, wherein the second distance is between 9.3-10 mm.

15. The step impedance resonator filter as claimed in claim 14, wherein the second distance is 9.3 mm.

* * * * *